US011206912B2

(12) United States Patent
Zhong

(10) Patent No.: US 11,206,912 B2
(45) Date of Patent: Dec. 28, 2021

(54) MULTI-COLOR PRESS-TYPE COSMETIC PEN

(71) Applicant: SHYA HSIN PACKAGING INDUSTRY (CHINA) CO., LTD., Kunshan (CN)

(72) Inventor: Hua Zhong, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 0 days.

(21) Appl. No.: 17/259,196

(22) PCT Filed: Feb. 13, 2019

(86) PCT No.: PCT/CN2019/074889
§ 371 (c)(1),
(2) Date: Jan. 11, 2021

(87) PCT Pub. No.: WO2020/062753
PCT Pub. Date: Apr. 2, 2020

(65) Prior Publication Data

US 2021/0267351 A1 Sep. 2, 2021

(30) Foreign Application Priority Data

Sep. 27, 2018 (CN) ..... 201811129728.9

(51) Int. Cl.
*A45D 40/20* (2006.01)
*A45D 40/24* (2006.01)
*A45D 40/06* (2006.01)

(52) U.S. Cl.
CPC ..... *A45D 40/20* (2013.01); *A45D 40/24* (2013.01); *A45D 40/06* (2013.01); *A45D 2200/054* (2013.01); *A45D 2200/055* (2013.01)

(58) Field of Classification Search
CPC ..... A45D 40/20; A45D 40/24; A45D 40/04; A45D 40/06; A45D 2200/054;
(Continued)

(56) References Cited

U.S. PATENT DOCUMENTS 8,523,469 B2 * 9/2013 Abergel ..... B65D 81/3288 401/35
2002/0070247 A1 * 6/2002 Kageyama ..... A45D 34/042 222/386

(Continued)

FOREIGN PATENT DOCUMENTS

CN 2796488 Y 7/2006
CN 200969964 Y 11/2007

(Continued)

*Primary Examiner* — David J Walczak
(74) *Attorney, Agent, or Firm* — Bayramoglu Law Offices LLC

(57) ABSTRACT

A multi-color press-type cosmetic pen includes a cylindrical pen body, a pen tip, and at least two actuating mechanisms. Each actuating mechanism includes a button, a ratchet, a ratchet wheel, a screw rod, a nut, a piston, and a spring. The button is fixed to the ratchet. Each of the ratchet and the ratchet wheel is hollow and cylindrical. The ratchet wheel is inserted into the ratchet. At least one inclined surface is provided on the outer peripheral wall of the ratchet wheel, and an abutting portion matched with the inclined surface is provided on the inner peripheral wall of the ratchet. The screw rod is inserted in the ratchet wheel. The nut is fixed on the pen body. The piston is mounted on the head the upper end of the screw rod. The spring abuts between the nut and the ratchet wheel.

7 Claims, 11 Drawing Sheets

(58) Field of Classification Search
CPC .. A45D 2200/055; A45D 34/00; A45D 34/04; A45D 40/02; A45D 40/205; A45D 2040/006; A45D 2040/205; B65D 83/0005; B65D 83/0011
USPC ..... 401/171–174, 17, 22, 25, 26, 44–47
See application file for complete search history.

(56) References Cited

U.S. PATENT DOCUMENTS

| | | | | |
|---|---|---|---|---|
| 2007/0086830 | A1* | 4/2007 | Kageyama | A45D 34/04 401/172 |
| 2009/0060624 | A1* | 3/2009 | Schenck | A61C 5/62 401/171 |
| 2014/0178118 | A1 | 6/2014 | Wu et al. | |

FOREIGN PATENT DOCUMENTS

| | | | |
|---|---|---|---|
| CN | 203762499 | U | 8/2014 |
| CN | 105686311 | A | 6/2016 |
| CN | 107981517 | A | 5/2018 |
| CN | 108991706 | A | 12/2018 |

* cited by examiner

MULTI-COLOR PRESS-TYPE COSMETIC PEN

CROSS REFERENCE TO THE RELATED APPLICATIONS

This application is the national phase entry of International Application No. PCT/CN2019/074889, filed on Feb. 13, 2019, which is based upon and claims priority to Chinese Patent Application No. 201811129728.9, filed on Sep. 27, 2018, the entire contents of which are incorporated herein by reference.

TECHNICAL FIELD

The present invention relates to the field of cosmetics, and more particularly, to a multi-color press-type cosmetic pen.

BACKGROUND

At present, makeup has become an indispensable part in people's daily life. Cosmetics come in various forms, such as powder, liquid, paste and so on. To facilitate the use of cosmetics, users generally make different cosmetics into different shapes and pack them in utilitarian containers. Among them, powder cosmetic products, such as lipstick, lip balm, concealer, skin whitening sticks and sunscreen sticks, are typically packed into strip-shaped tubes during design and manufacture.

Prior lip pens, on the market are generally single-color lip pens, which can only provide users with a single color, and users need to prepare a variety of lip pens in different colors to meet their needs. However, preparing a variety of lip pens in different colors undoubtedly increases the users' expense, and the storage of these lip pens also causes substantial inconvenience.

SUMMARY

In order to overcome the above-mentioned shortcomings, the present invention provides a multi-color press-type cosmetic pen to solve the problem of single color and single function of the single-color lip pens in the prior art.

In order to solve the technical problems, the present invention adopts the following technical solution. A multi-color press-type cosmetic pen includes a cylindrical pen body, a pen tip mounted at the front end of the pen body, and at least two actuating mechanisms mounted at the tail end of the pen body. Each actuating mechanism includes a button, a ratchet, a ratchet wheel, a screw rod, a nut, a piston, and a spring. The button is fixed to the ratchet. Each of the ratchet and the ratchet wheel is hollow and cylindrical. The ratchet wheel is inserted into the ratchet. At least one inclined surface is provided on the outer peripheral wall of the ratchet wheel, and an abutting portion matched with the inclined surface is provided on the inner peripheral wall of the ratchet. The screw rod is inserted in the ratchet wheel, and the outer wall of the screw rod is provided with a circular external thread. The nut is fixed on the pen body, and the inner wall of the nut is provided with a circular internal thread. The upper end of the screw rod is exposed outside the ratchet wheel, so that the circular external thread of the screw rod is engaged with the circular internal thread of the nut. The piston is mounted on the head of the upper end of the screw rod. The spring abuts between the nut and the ratchet wheel.

Further, the inner peripheral wall of the ratchet wheel forms a special-shaped cavity. Further, a pen tip base is arranged above the pen body, and the pen tip is partially embedded into the pen tip base and partially exposed outside the pen tip base.

Further, a cover is arranged above the pen body and configured to cover the pen tip. The inner peripheral wall of the cover is provided with an internal thread, and the outer wall of the pen tip base is provided with an external thread. The internal thread of the cover is engaged with the external thread of the pen tip base.

Further, the multi-color press-type cosmetic pen further includes a tail plug. The upper part of the tail plug is connected to the pen body, and the lower part of the tail plug forms a receiving space to receive the button.

Further, the pen body is provided with two liquid material receiving cavities, and two actuating mechanisms are arranged under the liquid material receiving cavities, respectively. The two actuating mechanisms are arranged side by side from left to right. The pen tip is correspondingly provided with two discharge holes, and two buttons are provided. The lower part of the tail plug correspondingly forms two receiving spaces.

Further, the pen body is provided with four liquid material receiving cavities, and four actuating mechanisms are arranged under the liquid material receiving cavities, respectively. The four actuating mechanisms are arranged in pairs side by side from front to back and from left to right. The pen tip is correspondingly provided with four discharge holes, and four buttons are provided. The lower part of the tail plug correspondingly forms four receiving spaces.

The present invention has the following advantages. The multi-color press-type cosmetic pen of the present invention integrates different color materials by means of at least two actuating mechanisms mounted at the tail end of the pen body, and the different color materials are separately discharged by pressing the different actuating mechanisms, thereby solving the problem of single color and single function of the single-color lip pens in the prior art.

Figure 1:
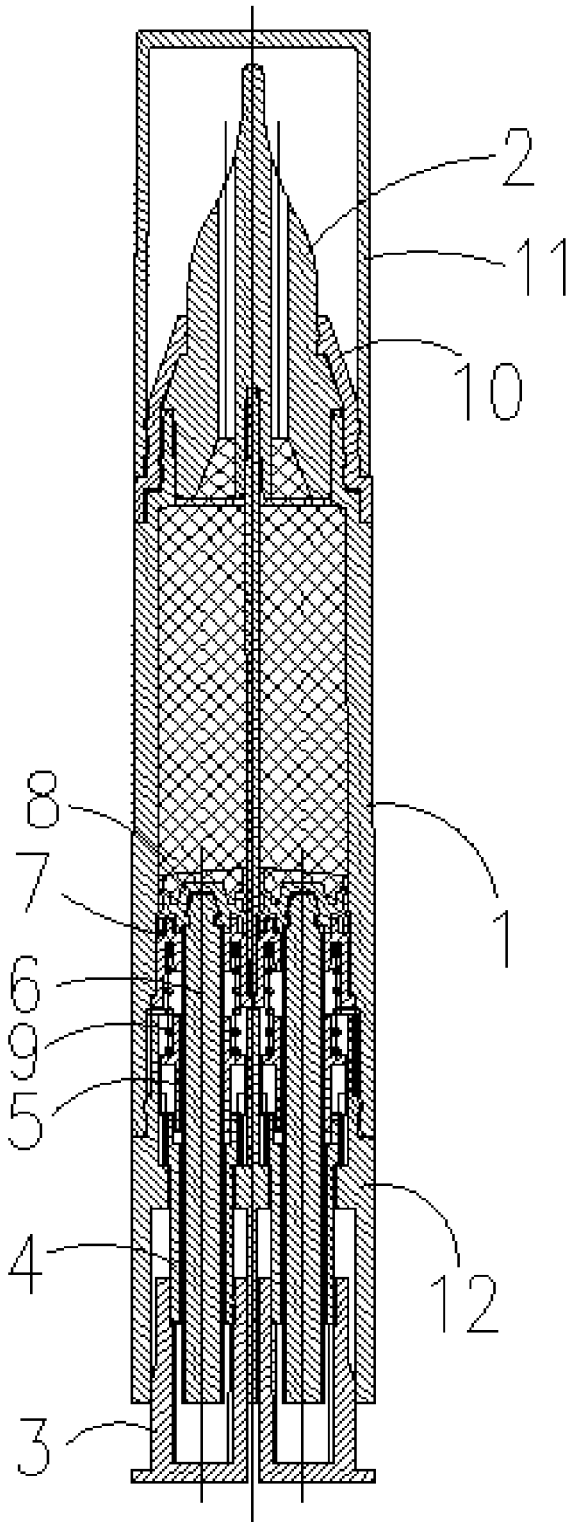
FIG. 1 is a schematic diagram of the structure of the multi-color press-type cosmetic pen according to the present invention.
Figure 2:
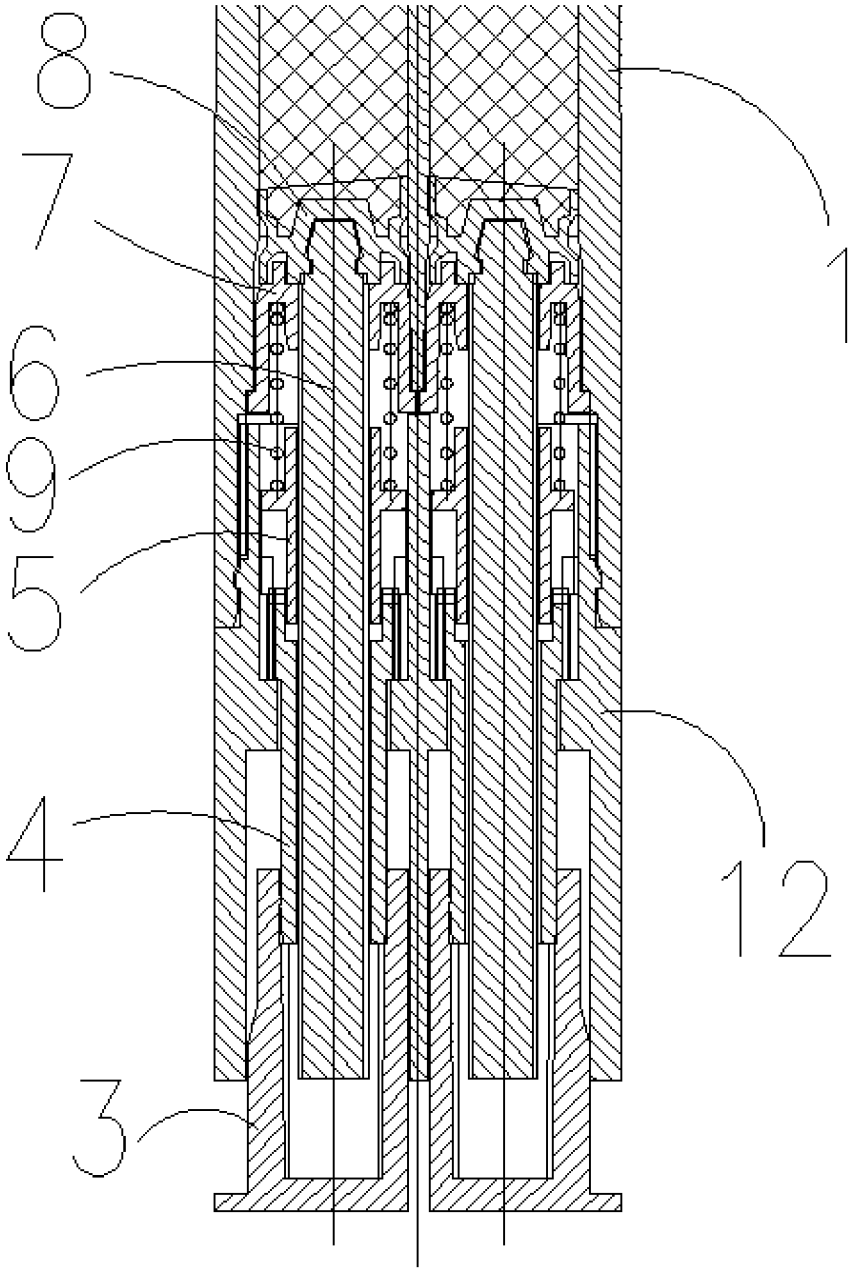
FIG. 2 is an enlarged view of the actuating mechanism in FIG. 1.
Figure 3:
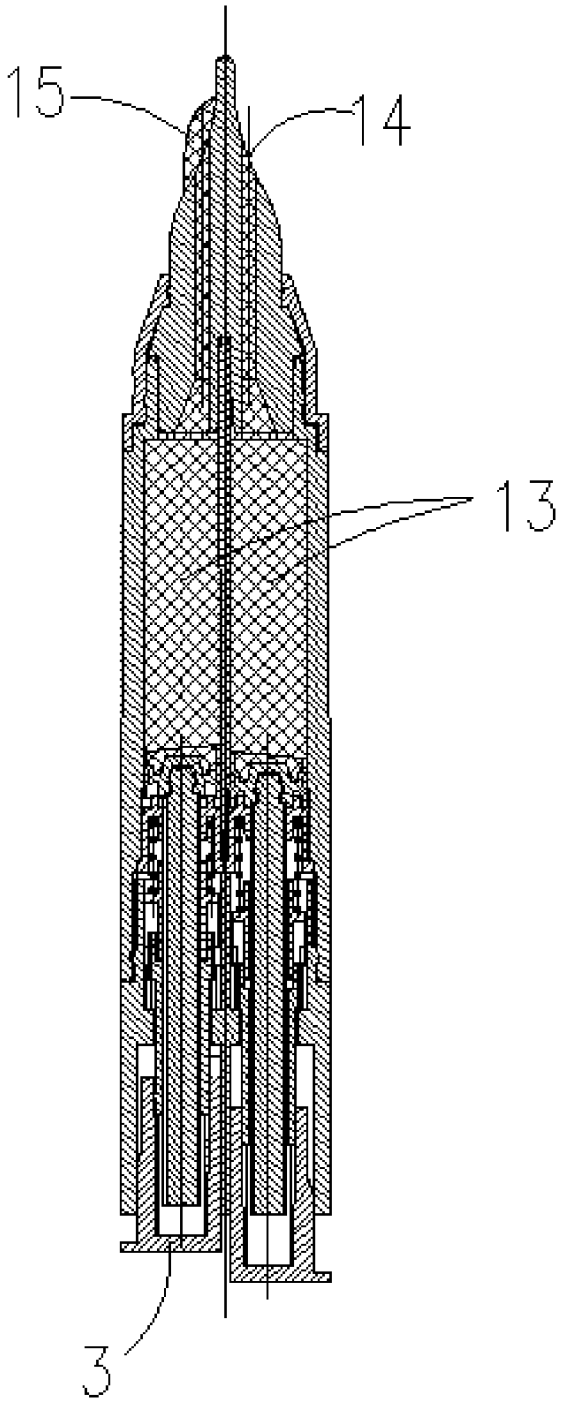
FIG. 3 is a schematic diagram of the first state of the multi-color press-type cosmetic pen in use according to the present invention.
Figure 4:
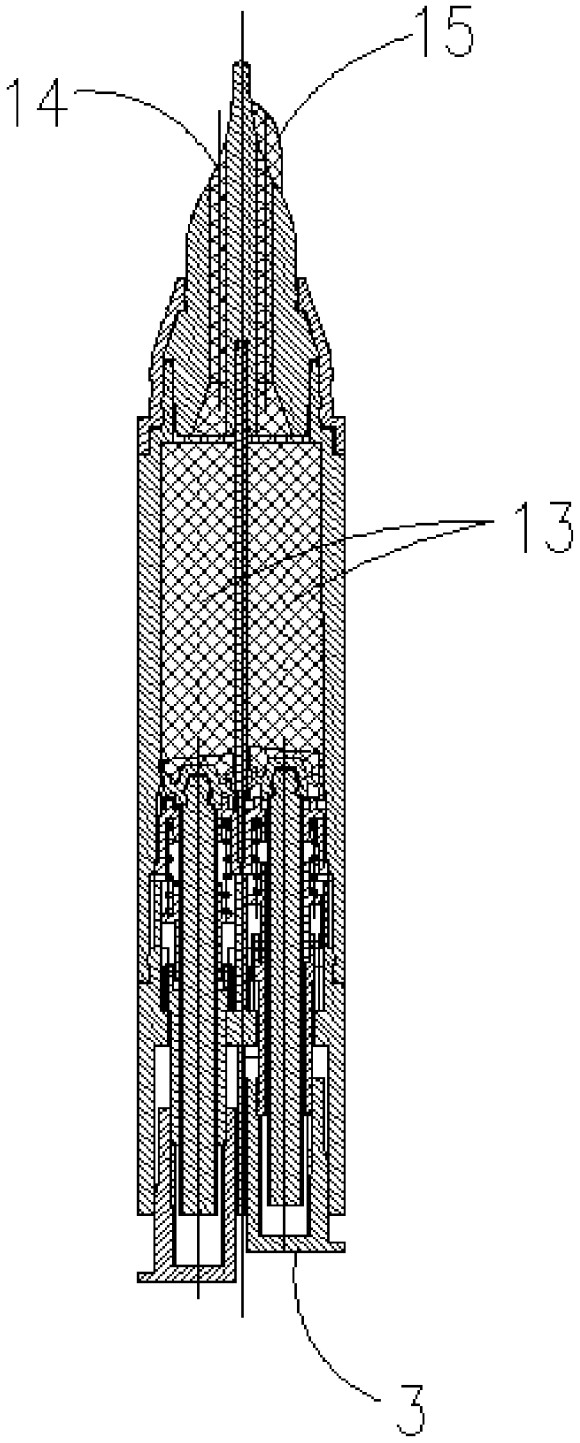
FIG. 4 is a schematic diagram of the second state of the multi-color press-type cosmetic pen in use according to the present invention.
Figure 5:
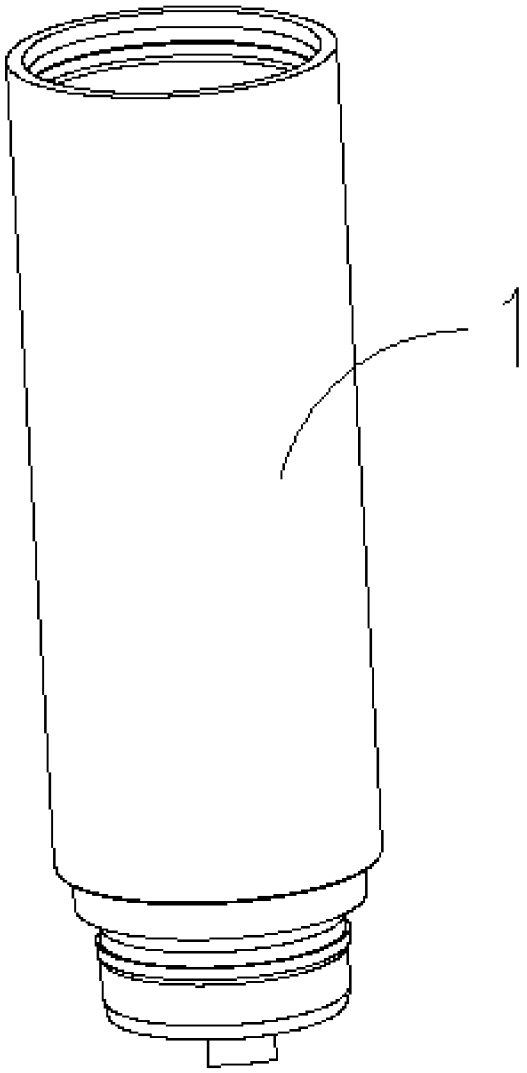
FIG. 5 is a perspective view of a pen body of the multi-color press-type cosmetic pen according to the present invention.
Figure 6:
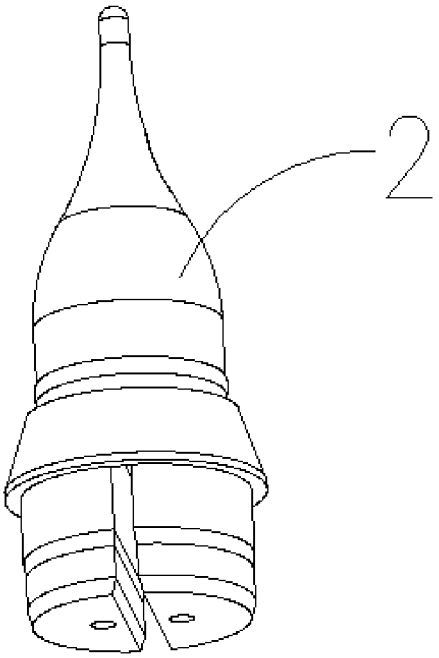
FIG. 6 is a perspective view of a pen tip of the multi-color press-type cosmetic pen according to the present invention.
Figure 7:
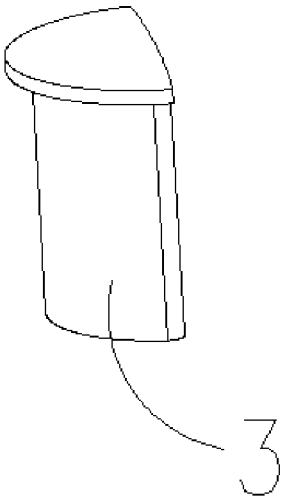
FIG. 7 is a perspective view of a button of the multi-color press-type cosmetic pen according to the present invention.
Figure 8:
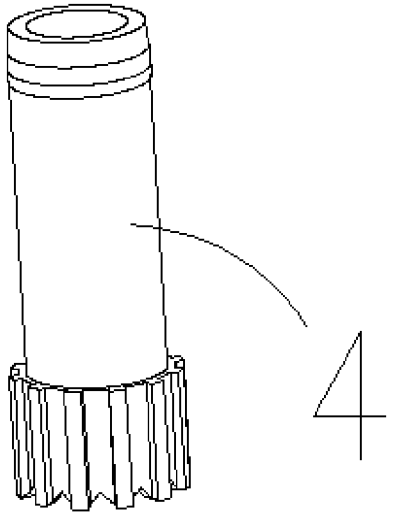
FIG. 8 is a perspective view of a ratchet of the multi-color press-type cosmetic pen according to the present invention.

1-pen body, 2-pen tip, 3-button, 4-ratchet, 5-ratchet wheel, 6-screw rod, 7-nut, 8-piston, 9-spring, 10-pen tip base, 11-cover, 12-tail plug, 13-liquid material receiving cavity, 14-discharge hole, 120-receiving space, 51-inclined surface, and 15-material.

DETAILED DESCRIPTION OF THE EMBODIMENTS

Referring to FIGS. 1-16, a multi-color press-type cosmetic pen includes the cylindrical pen body 1, the pen tip 2 mounted at the front end of the pen body 1, and at least two actuating mechanisms mounted at the tail end of the pen body 1. Each actuating mechanism includes the button 3, the ratchet 4, the ratchet wheel 5, the screw rod 6, the nut 7, the piston 8, and the spring 9. The button 3 is fixed to the ratchet 4. Each of the ratchet 4 and the ratchet wheel 5 is hollow and cylindrical. The ratchet wheel 5 is inserted into the ratchet 4. At least one inclined surface 51 is provided on the outer peripheral wall of the ratchet wheel 5, and an abutting portion (not shown) matched with the inclined surface 51 is provided on the inner peripheral wall of the ratchet 4. The screw rod 6 is inserted in the ratchet wheel 5, and the outer wall of the screw rod 6 is provided with a circular external thread. The nut 7 is fixed on the pen body 1, and the inner wall of the nut 7 is provided with a circular internal thread. The upper end of the screw rod 6 is exposed outside the ratchet wheel 5, so that the circular external thread of the screw rod 6 is engaged with the circular internal thread of the nut 7. The piston 8 is mounted on the head of the upper end of the screw rod 6. The spring 9 abuts between the nut 7 and the ratchet wheel 5.

Figure 9:
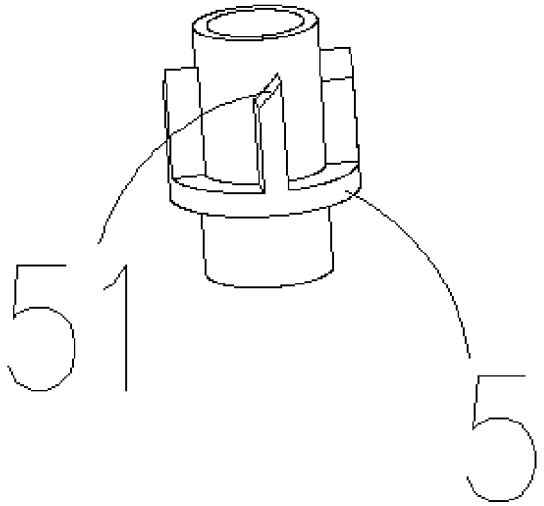
FIG. 9 is a perspective view of a ratchet wheel of the multi-color press-type cosmetic pen according to the present invention.
Figure 10:
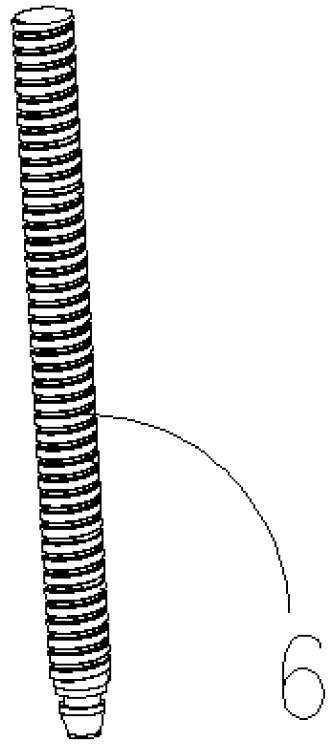
FIG. 10 is a perspective view of a screw rod of the multi-color press-type cosmetic pen according to the present invention.
Figure 11:
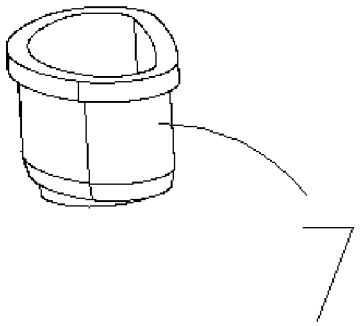
FIG. 11 is a perspective view of a nut of the multi-color press-type cosmetic pen according to the present invention.
Figure 12:
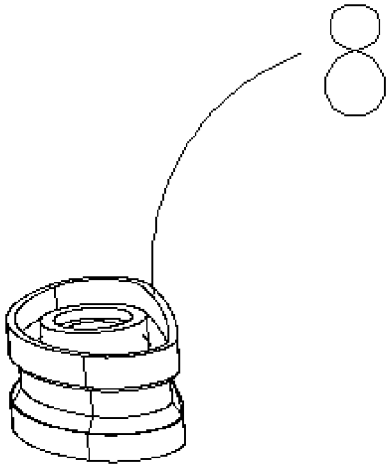
FIG. 12 is a perspective view of a piston of the multi-color press-type cosmetic pen according to the present invention.
Figure 13:
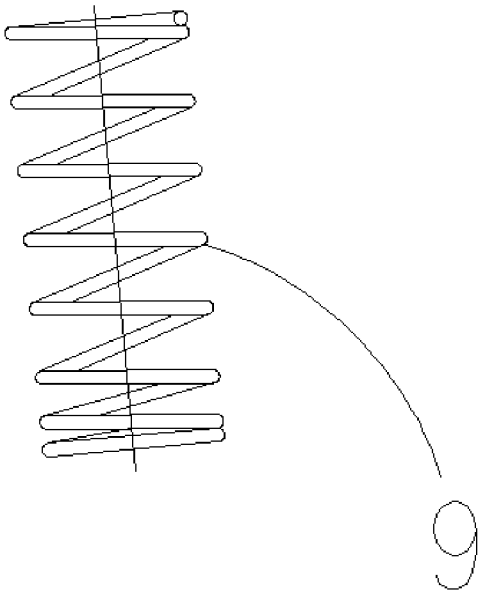
FIG. 13 is a perspective view of a spring of the multi-color press-type cosmetic pen according to the present invention.

Referring to FIGS. 9 and 10, the inner peripheral wall of the ratchet wheel 5 forms a special-shaped cavity. The outer wall of the screw rod 6 is provided with the circular external thread, and the inner peripheral wall of the ratchet wheel 5 forms a special-shaped (non-circular) inner cavity. Therefore, when the ratchet wheel 5 rotates, the screw rod 6 is driven to rotate a certain angle. In the course of rotating a certain angle, the screw rod 6 rises spirally by the engagement between the circular external thread and the circular internal thread.

Figure 14:
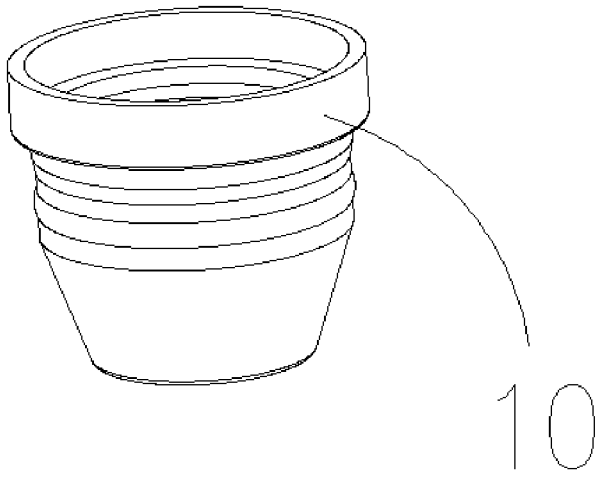
FIG. 14 is a perspective view of a pen tip base of the multi-color press-type cosmetic pen according to the present invention.

Referring to FIGS. 1 and 14, the pen tip base 10 is arranged above the pen body 1, and the pen tip 2 is partially embedded into the pen tip base 10 and partially exposed outside the pen tip base 10. That is, the pen tip 2 is connected to the pen body 1 through the pen tip base 10.

Figure 15:
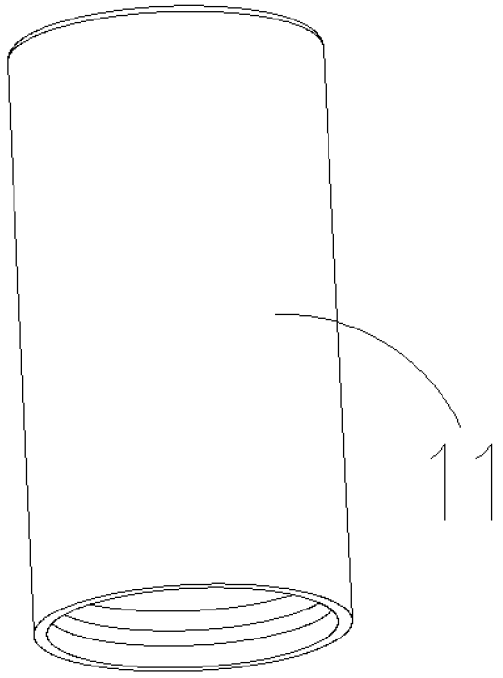
FIG. 15 is a perspective view of a cover of the multi-color press-type cosmetic pen according to the present invention.

Referring to FIGS. 1 and 15, the cover 11 is arranged above the pen body 1 and configured to cover the pen tip 2. The inner peripheral wall of the cover 11 is provided with an internal thread, and the outer wall of the pen tip base 10 is provided with an external thread. The internal thread of the cover 11 is engaged with the external thread of the pen tip base 10. That is, the cover 11 is fixedly locked on the pen tip base 10 to cover the pen tip 2, thus protecting the pen tip 2.

Figure 16:
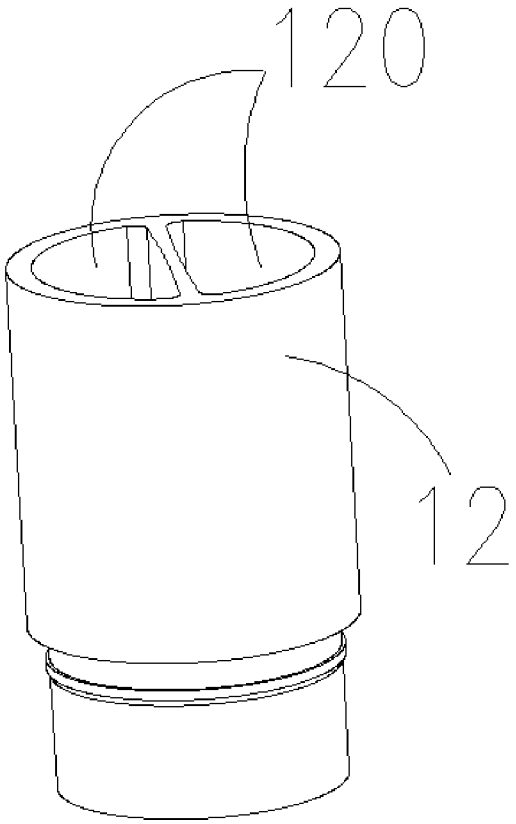
FIG. 16 is a perspective view of a tail plug of the multi-color press-type cosmetic pen according to the present invention.

Referring to FIGS. 1 and 16, the present invention further includes the tail plug 12. The upper part of the tail plug 12 is connected to the pen body 1, and the lower part of the tail plug 12 forms the receiving space 120 to receive the button 3. The tail plug 12 is configured to receive the button 3 and connect the button 3 to the pen body 1 to form an overall appearance.

Referring to FIGS. 1 and 16, the first implementation of the present invention is a two-color press-type cosmetic pen. The pen body 1 is provided with two liquid material receiving cavities 13, and two actuating mechanisms are arranged under the liquid material receiving cavities 13, respectively. The two actuating mechanisms are arranged side by side from left to right. The pen tip 2 is correspondingly provided with two discharge holes 14, and two buttons 3 are provided. The lower part of the tail plug 12 correspondingly forms two receiving spaces 120.

Similarly, the second implementation of the present invention is a four-color press-type cosmetic pen. The pen body 1 is provided with four liquid material receiving cavities 13, and four actuating mechanisms are arranged under the liquid material receiving cavities 13, respectively. The four actuating mechanisms are arranged in pairs side by side from front to back and from left to right. The pen tip 2 is correspondingly provided with four discharge holes 14, and four buttons 3 are provided. The lower part of the tail plug 12 correspondingly forms four receiving spaces 120.

The working principle of the multi-color press-type cosmetic pen of the present invention is as follows. The user presses the button 3, and the button 3 drives the ratchet 4 to squeeze forward. When the ratchet 4 pushes the ratchet wheel 5 to move forward, the ratchet wheel 5 twists and rotates through the inclined surface 51 at the front end thereof. The ratchet wheel 5 rotates to drive the screw rod 6 to rotate a certain angle, and the screw rod 6 rises spirally by the engagement between the external thread of the screw rod 6 and the internal thread of the nut 7. The screw rod 6 pushes the piston 8 forward, and the piston 8 pushes the material 15 to be discharged. In the process of discharging the material by means of pressing, the spring 9 is compressed to generate an elastic force. After the user releases the button 3, the elastic force of the spring 9 is released. Since the nut 7 is fixed on the pen body 1, the button 3, the ratchet 4, the ratchet wheel 5, the screw rod 6, the piston 8 and the spring 9 of the actuating mechanism are all reset to the original position under the action of the elastic force of the spring 9.

The multi-color press-type cosmetic pen of the present invention has at least two actuating mechanisms, which respectively push the liquid materials in different liquid material receiving cavity 13 to be discharged. The actuating mechanisms are independent of each other, and the liquid materials are separated from each other through the liquid material receiving cavities 13. Therefore, the multi-color press-type cosmetic pen of the present invention can not only enable the discharge hole 14 on the left side to discharge the liquid material by pressing the button 3 on the left side, but also enable the discharge hole 14 on the right side to discharge the liquid material by pressing the button 3 on the right side. The discharge hole 14 on the left side discharges the material 15 in one color, and the discharge hole 14 on the right side discharges the material 15 in another color. In this way, users can use one color alone or obtain a mixed color by using the cosmetic pen at least twice according to their preferences.

What is claimed is:

1. A multi-color press-type cosmetic pen, comprising a cylindrical pen body, a pen tip mounted at a front end of the cylindrical pen body, and at least two actuating mechanisms mounted at a tail end of the cylindrical pen body; wherein each actuating mechanism of the at least two actuating mechanisms comprises a button, a ratchet, a ratchet wheel, a screw rod, a nut, a piston, and a spring;

the button is fixed to the ratchet; each of the ratchet and the ratchet wheel is hollow and cylindrical;

the ratchet wheel is inserted into the ratchet;

at least one inclined surface is provided on an outer peripheral wall of the ratchet wheel, and an abutting portion matched with the at least one inclined surface is provided on an inner peripheral wall of the ratchet;

the screw rod is inserted in the ratchet wheel, and an outer wall of the screw rod is provided with a circular external thread;

the nut is fixed on the cylindrical pen body, and an inner wall of the nut is provided with a circular internal thread;

an upper end of the screw rod is exposed outside the ratchet wheel, and the circular external thread of the screw rod is engaged with the circular internal thread of the nut;

the piston is mounted on a head of the upper end of the screw rod; and the spring abuts between the nut and the ratchet wheel.

2. The multi-color press-type cosmetic pen according to claim 1, wherein an inner peripheral wall of the ratchet wheel forms a special-shaped cavity.

3. The multi-color press-type cosmetic pen according to claim 1, wherein a pen tip base is arranged above the cylindrical pen body; the pen tip is partially embedded into the pen tip base, and the pen tip is partially exposed outside the pen tip base.

4. The multi-color press-type cosmetic pen according to claim 3, wherein a cover is arranged above the cylindrical pen body, and the cover is configured to cover the pen tip; an inner peripheral wall of the cover is provided with an internal thread, and an outer wall of the pen tip base is provided with an external thread; and the internal thread of the cover is engaged with the external thread of the pen tip base.

5. The multi-color press-type cosmetic pen according to claim 1, further comprising a tail plug, wherein an upper part of the tail plug is connected to the cylindrical pen body, and a lower part of the tail plug forms a receiving spaces to receive the buttons.

6. The multi-color press-type cosmetic pen according to claim 5, wherein the at least two actuating mechanisms are two actuating mechanisms, the cylindrical pen body is provided with two liquid material receiving cavities, and the two actuating mechanisms are arranged under the two liquid material receiving cavities, respectively; the two actuating mechanisms are arranged side by side from left to right; the pen tip is provided with two discharge holes corresponding to the two actuating mechanisms, and two buttons are provided in the two actuating mechanisms, respectively; and the lower part of the tail plug forms two receiving spaces corresponding to the two buttons.

7. The multi-color press-type cosmetic pen according to claim 5, wherein the at least two actuating mechanisms are four actuating mechanisms, the cylindrical pen body is provided with four liquid material receiving cavities, and the four actuating mechanisms are arranged under the four liquid material receiving cavities, respectively; the four actuating mechanisms are arranged in pairs side by side from front to back and from left to right; the pen tip is provided with four discharge holes corresponding to the four actuating mechanisms, and four buttons are provided in the four actuating mechanisms, respectively; and the lower part of the tail plug forms four receiving spaces corresponding to the four buttons.

* * * * *